US006326418B1

(12) United States Patent
Nakai et al.

(10) Patent No.: US 6,326,418 B1
(45) Date of Patent: Dec. 4, 2001

(54) ACID-CURABLE, REFRACTORY PARTICULATE MATERIAL COMPOSITION FOR FORMING MOLD

(75) Inventors: Shigeo Nakai; Masayuki Kato; Masuo Sawa, all of Aichi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/331,666

(22) PCT Filed: Sep. 3, 1998

(86) PCT No.: PCT/JP98/03939

§ 371 Date: Jun. 23, 1999

§ 102(e) Date: Jun. 23, 1999

(87) PCT Pub. No.: WO99/14003

PCT Pub. Date: Mar. 25, 1999

(30) Foreign Application Priority Data

Sep. 12, 1997 (JP) ..... 9-248971

(51) Int. Cl.[7] ..... B22C 1/22
(52) U.S. Cl. ..... 523/139; 524/145
(58) Field of Search ..... 524/647; 525/505; 523/139, 144, 145, 146

(56) References Cited

U.S. PATENT DOCUMENTS

| | | | | |
|---|---|---|---|---|
| 4,195,458 | * | 4/1980 | Hoppe et al. | 52/234 |
| 4,296,793 | * | 10/1981 | Yasinsky et al. | 164/24 |
| 4,495,316 | * | 1/1985 | Armbuster | 523/139 |
| 4,615,372 | * | 10/1986 | Kopac et al. | 164/16 |
| 4,644,022 | * | 2/1987 | Iyer | 523/144 |
| 4,997,860 | * | 3/1991 | Kabeta | 523/144 |
| 5,248,707 | * | 9/1993 | Gerber | 524/145 |
| 5,459,178 | * | 10/1995 | Chan et al. | 523/139 |
| 5,491,180 | * | 2/1996 | Kiuchi et al. | 523/139 |

FOREIGN PATENT DOCUMENTS

| | | |
|---|---|---|
| A6431539 | 2/1989 | (JP) . |
| A2500753 | 3/1990 | (JP) . |
| A2211929 | 8/1990 | (JP) . |
| A352742 | 3/1991 | (JP) . |

* cited by examiner

*Primary Examiner*—Edward J. Cain
*Assistant Examiner*—Katarzyna Wyrozebski-Lee
(74) *Attorney, Agent, or Firm*—Birch, Stewart, Kolasch & Birch, LLP

(57) ABSTRACT

The present invention provides a refractory granular material composition for a self-hardening molding by acid-hardening, consisting essentially of: a refractory granular material, an acid-hardening resin-containing binder composition, an acid-containing hardener composition, and at least one solvent selected from the group consisting of (1) alcohols, (2) ether alcohols and ester shown below:

(1)

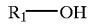

(2)

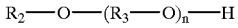

(3)

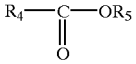

wherein $R_1$ represents a C4 to C8 straight-chain or branched aliphatic hydrocarbon group or a benzyl group; $R_2$ represents a C1 to C10 straight-chain or branched aliphatic hydrocarbon group, phenyl group or a benzyl group; $R_3$ represents an ethylene group or a propylene group; n is an integer of 1 to 12; $R_4$ represents, phenyl group or a methyl group; and R5 is a C2 to C6 aliphatic hydrocarbon group or $(R_3—O)_n R_2$.

13 Claims, No Drawings

ACID-CURABLE, REFRACTORY PARTICULATE MATERIAL COMPOSITION FOR FORMING MOLD

This application is the national phase under 35 U.S.C. § 371 of PCT International Application No. PCT/JP98/03939 which has an International filing date of Sep. 3, 1998, which designated the United States of America.

1. Technical Field

The present invention relates to a refractory granular material composition for molding by acid-hardening which can particularly be used preferably in producing a self-hardening mold.

2. Background Art

A certain method of producing a self-hardening mold involves blending an acid-hardening resin and a hardener with a refractory granular material such as silica sand and mixing them to produce a mold at room temperature. The hardener used include inorganic acids such as sulfuric acid and phosphoric acid, and organic sulfonic acids such as toluene sulfonic acid and xylene sulfonic acid, but further improvement in mold strength is desired. That is, if higher mold strength can be achieved, the amounts of the acid-hardening resin and the hardener can be reduced to decrease gas generated, so the environment can thereby be improved and gas defects in the resulting mold can be reduced.

DISCLOSURE OF THE INVENTION

The object of the present invention is to improve the strength of an acid-hardening mold.

The present invention relates to a refractory granular material composition for molding by acid-hardening which comprises at least one solvent selected from the group of (1) alcohols, (2) ether alcohols and (3) esters shown below:

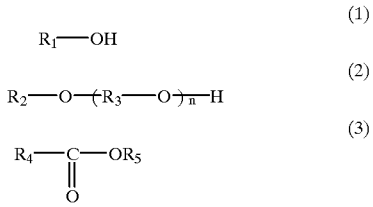

(1)

(2)

(3)

wherein:

$R_1$ represents a C3 to C12 straight-chain or branched aliphatic hydrocarbon group or a benzyl group;

$R_2$ represents a C1 to C10 straight-chain or branched aliphatic hydrocarbon group, a phenyl group or a benzyl group;

$R_3$ represents an ethylene group or a propylene group;

n is an integer of 1 to 12;

$R_4$ represents a phenyl group or a methyl group; and $R_5$ is a C2 to C6 aliphatic hydrocarbon group or —($R_3$—O)n—$R_2$ That is, the present invention relates to a refractory granular material composition for molding by acid-hardening comprising a refractory granular material, an acid-hardening resin-containing binder, an acid-continuing hardener, and at least one of the above-described solvents.

Further, the present invention provides a method of producing an acid-hardening mold comprising mixing a refractory granular material, an acid-hardening resin-containing binder, and an acid-containing hardener and hardening the acid-hardening resin to produce a foundry mold, wherein at least one of the above-described solvents is added to harden the acid-hardening resin.

The present invention provides an acid-hardening mold additive comprising one or more of the solvents described above. The above solvents are used as an additive for production of the acid-hardening resin. The solvents may have a solubility parameter of 8.5 to 12.

The present invention provides a method in which the refractory granular material, the binder, and the hardener and the solvents described above are mixed and hardened to produce a mold for use in producing castings.

The estimated reason that the above-identified solvents contribute to improvement in mold strength may be that they act as mutual solvent for improving binder and hardener solubility.

JP-A 2-500,753 discloses a binder composition which consists of an aqueous alkaline solution of specific phenol resol and a modifier selected from the group of open-chain ether alcohols and ketone alcohols and which can improve mold tensile strength. However, this prior art invention relates to a molding method for hardening alkaline phenol resin by ester and is completely different from the technique of the present invention in which acid-hardening resin is hardened by an acidic hardener composition to form a mold.

MODE FOR CARRYING OUT THE INVENTION

The refractory granular material composition for molding provided by the present invention is prepared by mixing of a refractory granular material, a binder composition containing an acid-hardening resin, and a hardener composition containing an inorganic acid such as sulfuric acid and phosphoric acid, and an organic acid such as an aromatic type sulfonic acid, and it is used for producing a foundry mold by hardening the acid-hardening resin. The refractory granular material include a new or reclaimed material of sand such as silica sand based mainly on quartz, a chromite sand, a zircon sand, a olivin sand, a alumina sand and a artificial mullite sand. Usually the reclaimed sand includes that obtained ordinarily in a mechanical abrasion system or calcination system, and the sand reclaimed in the abrasion system is preferable because of high yield and generality and from an economical viewpoint.

Examples of the acid-hardening resin include furfuryl alcohol (which becomes resin through polycondensation at the time of curing by the action of a hardener), the so-called furan resins such as furfuryl alcohol-aldehyde-urea polycondensate, furfuryl alcohol-aldehyde polycondensate, furfuryl alcohol-aldehyde-melamine polycondensate, and furfuryl alcohol polymer, and phenol resins such as phenol-aldehyde polycondensate. Further, the so-called phenol-modified furan resins such as furfuryl alcohol-phenol-aldehyde polycondensate and furfuryl alcohol-phenol-urea-aldehyde polycondensate can also be used. One or more of these acid-hardening resins can be used in combination thereof. Out of these acid-hardening resins, furan resin and phenol-modified furan resin are preferable because these can achieve particularly significant effects according to the present invention. The acid-hardening resin is used preferably in an amount of 0.6 to 5 parts by weight relative to 100 parts of the refractory granular material in the granular composition for molding.

In the present invention, phenols used in production of the acid-hardening resin include alkyl phenols such as phenol, cresol and 3,5-xylenol, polyvalent phenols such as resorcinol and catechol, and bisphenols such as bisphenol A, bisphenol F, bisphenol C and bisphenol E. Further, aldehydes may be publicly known aldehyde compounds such as formaldehyde, glyoxal and furfural.

In the acid-hardening resin of the present invention, urea and urea compounds, amines such as melamine, amides and phenols such as resorcin and bisphenol A besides the above major components can be contained for the purpose of reducing formaldehyde generated at the time of molding. In particular, resorcin is preferably contained in an amount of 2 to 30 parts by weight relative to 100 parts of the acid-hardening resin.

Further, 2,5-bishydroxymethyl furan or the like can be preferably contained as a curing accelerator in an amount of 0.5 to 30 parts by weight relative to 100 parts of the acid-hardening resin, thus achieving the significant effect of the present invention.

Further, a silane coupling agent such as N-β-(aminoethyl)-γ-aminopropylmethyldimethoxysilane or the like can be added for the purpose of improving mold strength.

The hardener composition used in the present invention includes inorganic acids such as sulfuric acid, phosphoric acid and organic acids such as aromatic sulfonic acid. Sulfuric acid may be contained as an unreacted material at the time of synthesizing organic sulfonic acid or incorporated into the hardener composition, and its content is preferably 2 to 50% by weight. In view of the effect of the solvent in the present invention, its content is more preferably 2 to 35% by weight, most preferably 2 to 20% by weight.

Phosphoric acid is contained for reducing the amount of sulfur dioxide gas generated from a mold at the time of molding and for improving a working atmosphere. The content of phosphoric acid in the hardener is preferably 5 to 85% by weight.

The organic acid includes publicly known organic sulfonic acids such as benzene sulfonic acid, toluene sulfonic acid, xylene sulfonic acid and phenol sulfonic acid. These organic sulfonic acids can be contained in the hardener to achieve relatively high mold strength, and the content thereof in the hardener is preferably 5 to 80% by weight for a working atmosphere.

In the present invention, the amount of organic sulfonic acids added can be reduced, and only one of the organic sulfonic acids can be used as the hardener.

The hardener composition is used preferably in an amount of 0.2 to 3 parts by weight relative to 100 parts of the refractory granular material. Further, when the hardener composition is used, publicly known additives such as curing accelerator can be used. Such other additives include carboxylic acids and surfactants.

According to the present invention, the granular composition for molding comprises one or more solvents selected from the group of alcohols of formula (1) above, ether alcohols of formula (2) above and esters of formula (3) above.

From a viewpoint of improving mold strength, the alcohols are preferably those where $R_1$ is a C4 to C8 straight-chain or branched aliphatic hydrocarbon group or a benzyl group, more preferably a C4 to C6 straight-chain or branched aliphatic hydrocarbon group or a benzyl group. The ether alcohols are those where $R_2$ is a C1 to C6 straight-chain or branched aliphatic hydrocarbon group or a phenyl group, more preferably a C4 straight-chain or branched aliphatic hydrocarbon group or a phenyl group, most preferably a phenyl group. The ether alcohols and esters are preferably those where n is 1 to 5, more preferably 1 to 2. Among these, the alcohols of formula (1) and the ether alcohols of formula (2) are preferable, and particularly the ether alcohols of formula (2) are more preferable to achieve the significant effect of the present invention.

Specific examples include alcohols such as propanol, butanol, pentanol, hexanol, heptanol, octanol and benzyl alcohol, ether alcohols such as ethylene glycol monoethyl ether, ethylene glycol monobutyl ether, ethylene glycol monohexyl ether, diethylene glycol monoethyl ether, diethylene glycol monobutyl ether, diethylene glycol monohexyl ether diethylene glycol monophenyl ether and ethylene glycol monophenyl ether, and esters such as butyl acetate, butyl benzoate, ethylene glycol monobutyl ether acetate and diethylene glycol monobutyl ether acetate, and p referable examples include 1-hexanol, diethylene glycol monobutyl ether, ethylene glycol monobutyl ether, diethylene glycol monophenyl ether and ethylene glycol monophenyl ether.

The solvent in the present invention is used preferably in an amount o f 0.01 to 0.3% by weight in the granular composition for molding. In respect of mold strength, it is used in an amount of more preferably 0.015 to 0.2% by weight, most preferably 0.02 to 0.15% by weight.

For production of a mold by use of the granular composition for molding of the present invention, e.g. 0.2 to 3 parts by weight of the hardener composition is first mixed with 100 parts of the granular material (hereinafter, "parts" mean parts by weight), and 0.6 to 5 parts of the binder composition is then mixed therewith to produce a mold. That is, the above production is publicly known method. The solvent is contained in an amount of 0.01 to 0.3 part preferably in the hardener composition or the binder composition, but maybe added to the refractory granular material (sand) at the time of molding or mixed with the refractory granular material, the binder composition and the hardener composition. Mixing, molding and hardening thereof do not particularly need heating and cooling, and atmospheric temperature can be used.

EXAMPLES

Synthesis Examples of acid-hardening resin are shown in below Synthesis Examples 1 to 3. Unless otherwise specified, "%" refers to % by weight.

Synthesis Example 1

Synthesis of furfuryl alcohol-phenol-formaldehyde polycondensate (phenol-modified furan resin)

975 parts (10.4 mol) of phenol and 18 parts (0.16 mol) of 48.5% aqueous potassium hydroxide were introduced into a four-necked flask equipped with a thermometer, a condenser and a stirrer, and 507 parts (15.5 mol) of 92% paraformaldehyde was added thereto for about 1 hour at a constant temperature of 80° C. After left at a constant temperature of 80° C. for additional 6 hours, it was immediately cooled and adjusted to pH 5.0 by neutralization with 50% sulfuric acid. After neutralization, the neutralized salt was separated by centrifugation. 1500 parts of furfuryl alcohol were added to the resulting resin, and 0.3 part of N-β(aminoethyl)γ-aminopropylmethyldimethoxysilane was added thereto to give a phenol-modified furan resin composition.

Synthesis Example 2

Systesis of phenol-formaldehyde polycondensate (phenol formaldehyde resin)

1950 parts (20.7 mol) of phenol and 36 parts (0.31 mol) of 48.5% aqueous potassium hydroxide were introduced into a four-necked flask equipped with a thermometer, a condenser and a stirrer, and 1014 parts (31.1 mol) of 92% paraformaldehyde was added thereto for about 1 hour at a constant temperature of 80° C. After the viscosity of the system reached 30,000 cps at 25° C., it was rapidly cooled and neutralized with 50% sulfuric acid until its pH value reached 5.0. After neutralization, the neutralized salt was separated by centrifugation. Water was added thereto until its water content reached 20%, and further 0.3 part of N-β(aminoethyl)γ-aminopropylmethyldimethoxysilane was added thereto to give a phenol formaldehyde resin composition.

Synthesis Example 3

Synthesis of furfuryl alcohol-urea-formaldehyde polycondensate (urea-modified furan resin)

682.4 parts (6.96 mol) of furfuryl alcohol, 85.7 parts (1.43 mol) of urea, 231.9 parts (2.86 mol) of 37% formaldehyde and 0.08 part of 25% aqueous sodium hydroxide were introduced into a four-necked flask equipped with a thermometer, a condenser and a stirrer, and the mixture was further reacted at 100° C. for 1 hour. Thereafter, 0.2 part of 10% hydrochloric acid was added thereto, followed by further reaction at 100° C. for 3 hours. 3.0 parts of N-β (aminoethyl)γ-aminopropylmethyldimethoxysilane were added thereto to give an urea-modified furan resin composition.

According to the present invention, the acid-hardening resin compositions thus obtained were used to prepare granular compositions for molding, and molds were formed. If solvent was to be added, it was added to and mixed with the resin compositions above prepared.

The following hardener composition was used and adjusted at desired concentrations shown in the table below. The content of the hardener shown in the table is expressed as the amount of its anhydride. m-xylene-4-sulfonic acid (a reagent produced by Tokyo Kasei Kogyo K. K.) sulfuric acid (97% industrial sulfuric acid) phosphoric acid (85% industrial phosphoric acid) p-toluenesulfonic acid (a reagent produced by Tokyo Kasei Kogyo K. K.)

EXAMPLE 1

0.5 part of the above hardener composition and 0.8 part of the phenol-modified furan resin composition (containing 5% 1-propanol) were added to 100 parts of new sand of Fremantle silica sand under the conditions of 25° C. and 50% RH, and the resulting mixture was filled into a test piece frame to prepare a cylindrical test piece with a diameter of 50 mm and a height of 50 mm, and the compressive strength (kg/cm$^2$) of the test piece body was determined after 24 hours according to a method described in JIS Z 2604-1976. The result is shown in Table 1.

EXAMPLES 2 to 30 AND COMPARATIVE EXAMPLES 1 TO 12

The compressive strengths (kg/cm$^2$) of test piece bodies were determined in the same manner as in Example 1 except that the type of the acid-hardening resin composition, the type and content of the solvent in the resin composition, and the type and content of the acid in the hardener composition were as shown in Tables 1 to 4.

INDUSTRIAL APPLICABILITY

According to the granular composition for molding by acid-hardening of the present invention, which comprises the solvents, the strength of the resulting mold can be improved.

FIG. 1

| Examples and Comparative Examples | Type of acid-hardening resin | Type of solvent | Solvent content in sand composition (%) | Sulfuric acid content in hardener composition (%) | m-xylene-4-sulfonic acid content in hardener composition (%) | Water content in hardener composition (%) | Compressive strength after 24 hours since molding (kg/cm$^2$) |
|---|---|---|---|---|---|---|---|
| Example 1 | Phenol-modified furan resin | 1-propanol | 0.04 | 8 | 44.5 | 47.5 | 34.2 |
| Example 2 | Phenol-modified furan resin | 1-butanol | 0.005 | 8 | 44.5 | 47.5 | 30.1 |
| Example 3 | Phenol-modified furan resin | 1-butanol | 0.04 | 8 | 44.5 | 47.5 | 35.7 |
| Example 4 | Phenol-modified furin resin | 1-butanol | 0.35 | 8 | 44.5 | 47.5 | 29.8 |
| Example 5 | Phenol-modified furan resin | 2-butanol | 0.04 | 8 | 44.5 | 47.5 | 37.3 |
| Example 6 | Phenol-modified furan resin | 1-hexanol | 0.04 | 8 | 44.5 | 47.5 | 39.7 |
| Example 7 | Phenol-modified furan resin | Diethylene glycol mono-n-butyl ether | 0.01 | 8 | 44.5 | 47.5 | 35.6 |
| Example 8 | Phenol-modified furan resin | Diethylene glycol mono-n-butyl ether | 0.04 | 8 | 44.5 | 47.5 | 38.4 |
| Example 9 | Phenol-modified furan resin | Diethylene glycol mono-n-butyl ether | 0.08 | 8 | 44.5 | 47.5 | 38.3 |
| Example 10 | Phenol-modified furan resin | Diethylene glycol mono-n-butyl ether | 0.12 | 8 | 44.5 | 47.5 | 38.1 |
| Example 11 | Phenol-modified furan resin | Diethylene glycol mono-n-butyl ether | 0.16 | 8 | 44.5 | 47.5 | 35.1 |
| Example 12 | Phenol-modified furan resin | Ethylene glycol mono-n-butyl ether | 0.04 | 8 | 44.5 | 47.5 | 39.9 |
| Example 13 | Phenol-modified furan resin | Butyl benzoate | 0.04 | 8 | 44.5 | 47.5 | 36.1 |
| Example 14 | Phenol-modified furan resin | Ethylene glycol mono-n-butyl ether acetate | 0.04 | 8 | 44.5 | 47.5 | 33.8 |
| Example 15 | Phenol-modified furan resin | Ethylene glycol mono-n-butyl ether | 0.04 | 15 | 30 | 55 | 35.0 |
| Example 16 | Phenol-modified furan resin | Ethylene glycol mono-n-butyl ether | 0.1 | 25 | 12 | 63 | 31.2 |
| Example 17 | Phenol-modified furan resin | Ethylene glycol mono-n-butyl ether | 0.1 | 35 | 0 | 65 | 29.6 |

FIG. 2

| Examples and Comparative Examples | Type of acid-hardening resin | Type of solvent | Solvent content in sand composition (%) | Sulfuric acid content in hardener composition (%) | m-xylene-4-sulfunic acid content in hardener composition (%) | Water content in hardener composition (%) | Compressive strength after 24 hours since molding (kg/cm$^2$) |
|---|---|---|---|---|---|---|---|
| Example 18 | Phenol-modified furan resin | Diethylene glycol monophenyl ether | 0.04 | 8 | 44.5 | 47.5 | 42.7 |
| Example 19 | Urea-modified furan resin | 1-butanol | 0.04 | 8 | 65 | 27 | 38.4 |
| Example 20 | Urea-modified furan resin | Eethylene glycol mono-n-butyl ether | 0.04 | 8 | 65 | 27 | 36.8 |
| Example 21 | Urea-modified furan resin | Diethylene glycol mono-n-butyl ether | 0.04 | 8 | 65 | 27 | 41.1 |
| Example 22 | Urea-modified furan resin | Ethylene glycol monophenyl ether | 0.04 | 8 | 65 | 27 | 42.8 |
| Example 23 | Urea-modified furan resin + 5 wt-% resorcinol | Ethylene glycol monophenyl ether | 0.04 | 7 | 58 | 35 | 46.2 |
| Example 24 | Urea-modified furan resin + 5 wt-% 2,5-bishydroxymethyl furan | Ethylene glycol monophenyl ether | 0.04 | 7 | 58 | 35 | 47.9 |
| Example 25 | Urea-modified furan resin + 5 wt-% resorcinol 5 wt-% 2,5-bishydroxymethyl furan | Ethylene glycol monophenyl ether | 0.04 | 6.5 | 50 | 43.5 | 52.9 |
| Example 26 | Phenol formaldehyde resin | 1-butanol | 0.04 | 8 | 65 | 27 | 33.5 |
| Example 27 | Phenol formaldehyde resin | Diethylene glycol monophenyl ether | 0.04 | 8 | 65 | 27 | 33.5 |
| Comparative Example 1 | Phenol-modified furan resin | Furfuryl alcohol | 0.04 | 8 | 44.5 | 47.5 | 27.0 |
| Comparative Example 2 | Urea-modified furan resin | None | 0 | 8 | 65 | 27 | 33.8 |
| Compartive Example 3 | Phenol formaldehyde resin | None | 0 | 8 | 65 | 27 | 26.7 |
| Comparative Example 4 | Phenol-modified furan resin | None | 0 | 8 | 44.5 | 47.5 | 26.5 |
| Comparative Example 5 | Phenol-modified furan resin | Methanol | 0.04 | 8 | 44.5 | 47.5 | 27.2 |
| Comparative Example 6 | Phenol-modified furan resin | Ethylcene glycol dibutyl ether | 0.04 | 8 | 44.5 | 47.5 | 29.4 |

FIG. 3

| Examples and Comparative Examples | Type of acid-hardening resin | Type of solvent | Solvent content in sand composition (%) | Phosphoric acid content in hardener composition (%) | m-xylene-4-sulfonic acid content in hardener composition (%) | Water content in hardener composition (%) | Compressive strength after 24 hours since molding (kg/cm$^2$) |
|---|---|---|---|---|---|---|---|
| Example 28 | Phenol-modified furan resin | Ethylene glycol mono-n-butyl ether acetate | 0.04 | 8 | 44.5 | 47.5 | 33.8 |
| Example 29 | Phenol-modified furan resin | Ethylene glycol mono-n-butyl ether | 0.04 | 15 | 30 | 55 | 35.0 |
| Example 30 | Phenol-modified furan resin | Ethylene glycol mono-n-butyl ether | 0.1 | 25 | 12 | 63 | 31.2 |
| Example 31 | Phenol-modified furan resin | Ethylene glycol mono-n-butyl ether | 0.1 | 35 | 0 | 65 | 29.6 |
| Example 32 | Phenol-modified furan resin | Diethylene glycol mono-n-butyl ether | 0.04 | 75 | 0 | 25 | 29 |
| Comparative Example 7 | Phenol-modified furan resin | — | 0.04 | 8 | 44.5 | 47.5 | 26.9 |
| Comparative Example 8 | Phenol-modified furan resin | — | 0.04 | 15 | 30 | 55 | 22.9 |
| Comparative Example 9 | Phenol-modified furan resin | — | 0.04 | 25 | 12 | 63 | 18.5 |
| Comparative Example 10 | Phenol-modified furan resin | — | 0.04 | 35 | 0 | 65 | 12.0 |
| Comparative Example 11 | Phenol-modified furan resin | None | — | 75 | 0 | 25 | 12 |

FIG. 4

| Examples and Comparative Examples | Type of acid-hardening resin | Type of solvent | Solvent content in sand composition (%) | Sulfuric acid content in hardener composition (%) | p-toluene sulfonic acid content in hardener composition (%) | Water content in hardener composition (%) | Compressive strength after 24 hours since molding (kg/cm$^2$) |
|---|---|---|---|---|---|---|---|
| Example 33 | Urea-modified furan resin | Ethylene glycol mono-n-butyl ether | 0.04 | 0 | 70 | 30 | 42 |
| Comparative Example 12 | Urea-modified furan resin | — | 0 | 0 | 70 | 30 | 35 |

What is claimed is:

1. A refractory granular material composition for a self-hardening molding by acid-hardening, consisting essentially of:

a refractory granular material;

an acid-hardening resin-containing binder;

an acid-containing hardener; and at least one solvent selected from the group consisting of (1) alcohols, (2) ether alcohols and ester shown below:

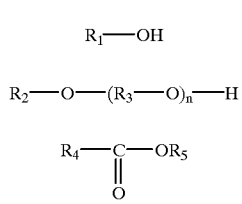

(1)

(2)

(3)

wherein $R_1$ represents a C4 to C8 straight-chain or branched aliphatic hydrocarbon group or a benzyl group;

$R_2$ represents a C 1 to C 10 straight-chain or branched aliphatic hydrocarbon group, phenyl group or a benzyl group;

$R_3$ represents an ethylene group or a propylene group;

n is an integer of 1 to 12;

$R_4$ represents a phenyl group or a methyl group; and R5 is a C2 to C6 aliphatic hydrocarbon group or $(R_3—O)_n R_2$.

2. The composition as described in claim 1, wherein the content of the solvent in the composition is 0.01 to 0.3% by weight.

3. The composition as described In claim 1, wherein the hardener is contained in an amount of 0.2 to 3 parts by weight to 100 parts by weigh of the refractory granular material, and the acid is at least one member selected from the group consisting of sulfuric acid, phosphoric acid and aromatic sulfonic acid.

4. A method of producing a self-hardening mold according to claim 1, comprising:

mixing a refractory granular material, an acid-hardening resin-containing binder and an acid-containing hardener, and hardening the acid-hardening resin to produce a foundry mold, wherein one or more of the solvents are added to harden the acid-hardening resin.

5. The composition as described in claim 1, wherein the solvent is one of the alcohols (1).

6. The method as described in claim 4, wherein 0.01 to 0.3% by weight of the solvent is added.

7. The refractory granular material composition for a self-hardening molding by acid-hardening according to claim 1, wherein the refractory granular material is selected from the croup consisting of new or reclaimed silica sand, chromite sand, zircon sand, olivin sand, alumina sand and artificial mullite sand.

8. The refractory granular material composition for a self-hardening molding by acid-hardening according to claim 1, wherein the solvent is selected from the group consisting of butanol, pentanol, hexanol, heptanol, octanol and benzyl ether.

9. The refractory granular material composition For a self-hardening molding by acid-hardening, according to claim 1, wherein the solvent is selected from the group consisting of ethylene glycol monoethyl ether, ethylene glycol monobutyl ether, ethylene glycol monohexyl ether, diethylene glycol monoethyl ether, diethylene glycol monobutyl ether, diethylene glycol monohexyl ether, diethylene glycol monophenyl ether and ethylene glycol monophenyl ether.

10. The refractory granular material composition for a self-hardening molding by acid-hardening, according to claim 1, wherein the solvent is selected from the group consisting of butyl acetate, butyl benzoate, ethylene glycol monobutyl ether acetate and diethylene glycol monobutyl ether acetate.

11. She refractory granular material composition for a self-hardening molding by acid-hardening, according to claim 1, wherein the solvent is selected from the group consisting of 1-hexanol, diethylene glycol monobutyl ether, ethylene glycol monobutyl ether, diethylene glycol monophenyl ether and ethylene glycol monophenyl ether.

12. The refractory granular material composition for a self-hardening molding by acid-hardening, according to claim 1, wherein 0.6 to 5 parts by weight of the acid-hardening resin-containing binder is used based on 100 parts of the refractory granular material.

13. The refractory granular material composition for a self-hardening molding by acid-hardening, according to claim 1, wherein 0.6 to 5 parts by weight of the acid-hardening resin-containing binder is used based on 100 parts of the refractory granular material.

* * * * *